US006896036B2

(12) United States Patent
Schneiders et al.

(10) Patent No.: US 6,896,036 B2
(45) Date of Patent: May 24, 2005

(54) METHOD OF MAKING TURBINE BLADES HAVING COOLING CHANNELS

(75) Inventors: Wilfried Schneiders, Bochum (DE); Theodor Schmitte, Bochum (DE); Jörn Grossmann, Hattingen (DE)

(73) Assignee: Doncasters Precision Castings-Bochum GmbH, Bochum (DE)

( * ) Notice: Subject to any disclaimer, the term of this patent is extended or adjusted under 35 U.S.C. 154(b) by 0 days.

(21) Appl. No.: 10/636,483

(22) Filed: Aug. 7, 2003

(65) Prior Publication Data

US 2004/0055736 A1 Mar. 25, 2004

(30) Foreign Application Priority Data

Aug. 8, 2002 (DE) ..... 102 36 339

(51) Int. Cl.[7] ..... B22C 9/04; B22C 9/10; B22C 21/14

(52) U.S. Cl. ..... 164/516; 164/70.1; 164/137; 164/361; 164/369; 164/397

(58) Field of Search ..... 164/516, 361, 164/369, 397, 398, 399, 70.1, 262, 137

(56) References Cited

U.S. PATENT DOCUMENTS

| | | | | | |
|---|---|---|---|---|---|
| 1,563,480 | A | * | 12/1925 | Gibson | 164/399 |
| 3,596,703 | A | * | 8/1971 | Bishop et al. | 164/132 |
| 4,596,281 | A | * | 6/1986 | Bishop | 164/32 |
| 4,811,778 | A | * | 3/1989 | Allen et al. | 164/516 |
| 4,986,333 | A | * | 1/1991 | Gartland | 164/30 |
| 5,296,308 | A | * | 3/1994 | Caccavale et al. | 428/586 |
| 5,623,985 | A | * | 4/1997 | Wheaton et al. | 164/516 |
| 6,119,761 | A | * | 9/2000 | Anazawa et al. | 164/35 |
| 6,349,759 | B1 | * | 2/2002 | Wheaton | 164/361 |
| 6,364,001 | B1 | * | 4/2002 | Cross | 164/516 |
| 6,675,868 | B2 | * | 1/2004 | Dodd | 164/412 |

FOREIGN PATENT DOCUMENTS

| | | | | |
|---|---|---|---|---|
| DE | 38 13 287 | | 12/1988 | B22D/15/02 |
| DE | 199 26 817 | | 12/2000 | F01D/5/18 |
| EP | 0 324 229 | | 7/1989 | B22C/9/10 |
| GB | 2 202 772 A | * | 10/1988 | B22C/9/10 |

* cited by examiner

*Primary Examiner*—Kevin P. Kerns
(74) *Attorney, Agent, or Firm*—Herbert Dubno

(57) ABSTRACT

To prevent movement of a ceramic core in a ceramic shell for the investment casting of a turbine blade, the free end of the core has one or more pins embedded therein so that the pins project into both the core and the ceramic shell which is applied over a wax layer. After removal of the wax and firing of the shell, molten metal is cast in the space left by the wax between the core and the shell. After hardening of the metal, the outwardly projecting part of the pins are removed during the machining of the surfaces of the turbine blade blank.

1 Claim, 4 Drawing Sheets

METHOD OF MAKING TURBINE BLADES HAVING COOLING CHANNELS

FIELD OF THE INVENTION

Our present invention relates to a method of making turbine blades using investment casting or, more generally, a wax layer to form a casting space.

BACKGROUND OF THE INVENTION

The production of turbine blades by a process in which a ceramic core is surrounded by a wax layer which may be injected or sprayed thereon and in which the wax layer, by repeated immersion and coating with ceramic material, is provided with a ceramic shell is known. After removal of the wax, the ceramic shell is fired and the space formed by the removal of the wax between the ceramic shell and the ceramic core is filled with a molten metal and, after hardening of the molten metal, the shell and the core are removed and the resulting metallic turbine blade blank can be mechanically processed, e.g. by machining.

Stabilization of the core within the shell is a problem.

In the past the lower end of the core, corresponding to the base of the blade, was fixed on casting. Nevertheless the free end of the blade, i.e. the end remote from the base, had a tendency to shift in the shell and cause variations in the wall thickness of the blade in the regions of the free end.

It has been proposed heretofore to press into the wax layer, upon which the shell is later formed, pins which rest against the core and can project beyond the wax layer (see DE 38 13 287 C2 and EP 0 324 229 B1). The ends of the pins projecting beyond the wax layer are embedded in the shell which is formed around the wax layer and then constitutes the mold for the cast metal. Such pins, after removal of the wax, tend to limit movement of the core. However, the fabrication of turbine blades by this method has been found to be expensive and this is in part because the setting of the pins is less than reliable. Furthermore, depending upon the pin material used, there may be local variations in material properties of the turbine blade which can give rise to problems, for example, in the subsequent coating of the turbine blades.

In another known process (see EP 0 585 183 A1) the core is provided with projections bumps which serve as spacers. It has also been proposed to remove the wax layer on the core at selected regions so that projections or spacers can be formed by the mold shell. This is described, for example, in U.S. Pat. No. 6,364,001. Even these methods are expensive from a production point of view, since they complicate the subsequent machining and do not always guarantee a reproducible, desired and reliable wall thickness at least at the free end of the turbine blade.

OBJECTS OF THE INVENTION

It is, therefore, the principal object of the present invention to provide a method of making a turbine blade having cooling channels which obviates the drawbacks of the earlier systems described and can more reliably prevent shifting of the core relative to the mold shell at least at the free end of the core during the casting process.

Another object of the invention is to provide an improved method of making a turbine blade and in which concerns about the properties of material or surfaces which have hitherto been prominent in this field are no longer significant.

Still another object of this invention is to provide an improved method of making a turbine blade which is more economical and reliable than prior art techniques.

SUMMARY OF THE INVENTION

These objects and others which will become apparent hereinafter are attained, in accordance with the invention in a method of making a turbine blade having cooling channels which comprises:

(a) producing an elongated ceramic core having a base portion at a base of a turbine blade to be made and a free end opposite the base portion, embedding at least one pin at the free end of the core so that the pin projects from the free end;

(b) covering the ceramic core with a wax layer;

(c) forming a ceramic shell on the wax layer by repeated immersion of the ceramic core with the wax layer thereon in a binder and coating with a ceramic material whereby the pin has opposite extremities embedded in the core and in the shell;

(d) removing the wax from between the core and the ceramic shell to leave a space therebetween;

(e) firing the ceramic shell;

(f) casting a molten metal into the space and hardening the metal, thereby forming a turbine blade blank, whereby the pin is incorporated in the turbine blade blank;

(g) removing the core and the shell from the blade blank whereby the extremities of the pin project therefrom; and (h) machining the blade blank to form the turbine blade, thereby machining away the extremity of the pin which extended into the shell.

Thus, according to the invention the pin serving for positioning the free end of the core in the shell is, according to the invention, embedded in both the core and the mold shell while the projecting end of the pin, following the separation of the turbine blade blank from the shell and the core is then machined away, i.e. is removed by the mechanical processing to which the turbine blade blank is subjected.

As a result, the material characteristics, the wall thickness and the surface characteristics of all of the regions of the turbine blade in which these are functionally significant are unaffected by the arrangement of th pin or pins. The pin can be embedded in the ceramic core without additional expense. The projecting portion of the pin, generally extending out of the so-called crown bottom of the turbine blade, can easily be removed. The end of the pin projecting downwardly from the crown body and within the blade need not be removed. It will be understood that the dimensions of the pin can be so selected that on the one hand it can be embedded firmly and fixedly in the core material and on the other hand provide sufficient stability for the core during casting.

Preferably the pin is made from a nickel alloy, especially NICr82. Such an alloy is substantially resistant to oxidation and has sufficient mechanical strength in the high temperature range above 1400° C. Other known materials can be used for the pin including, for example, platinum, noble metals and their alloys, especially palladium based alloys, and tungsten or tungsten alloys. It is also possible to provide the pin of a ceramic material.

When a pin is used which tends to oxidize during the firing of the mold shell, an embodiment of the invention provides that the pin has an abutment which engages with the metal of the turbine blade. Such an abutment can be formed in the simplest case by a circumferential groove. The pin can then be so embedded in the core that the circumferential groove is located in the region of the crown bottom of the turbine blade which is to be formed.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
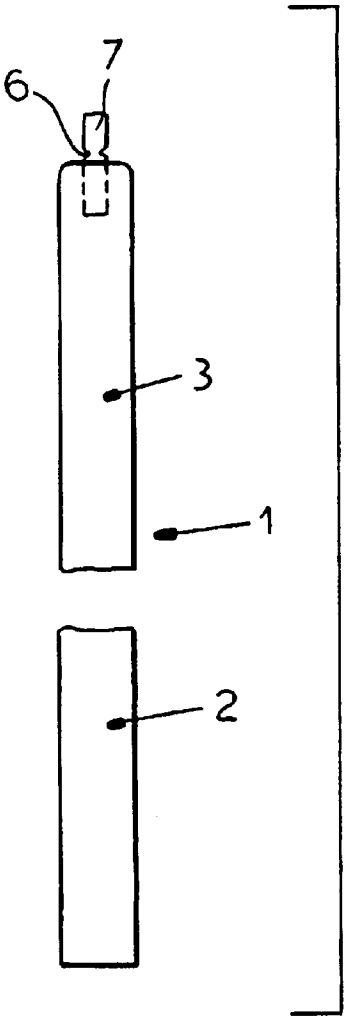
FIG. 2 is a side view of the core of FIG. 1.
Figure 1:
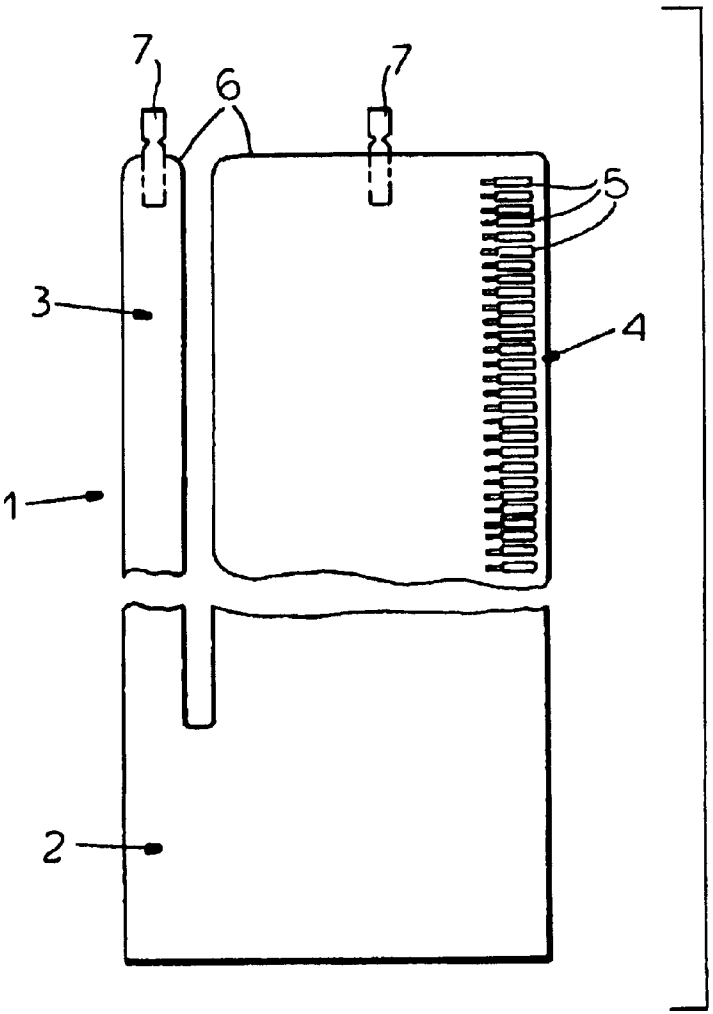
FIG. 1 is an elevational view of a broad side of a core which is to be used for producing a turbine blade with cooling channels.

The core 1 illustrated in FIGS. 1 and 2 is comprised of a ceramic material. The lower section 2 of this core, adapted to form the base of the turbine blade, is designed to be engaged in a holder which is not shown. From this lower section two upper sections 3 and 4 extend and are substantially parallel to one another. At least the upper section 4 has formations or profilings 5 which serve to produce cooling channels in the turbine blade. During the formation of the core 1 at the upper end 6 opposite the base 2, pins 7 are embedded. The pins 7 are composed of nickel alloys, especially NiCr82.

Figure 3:
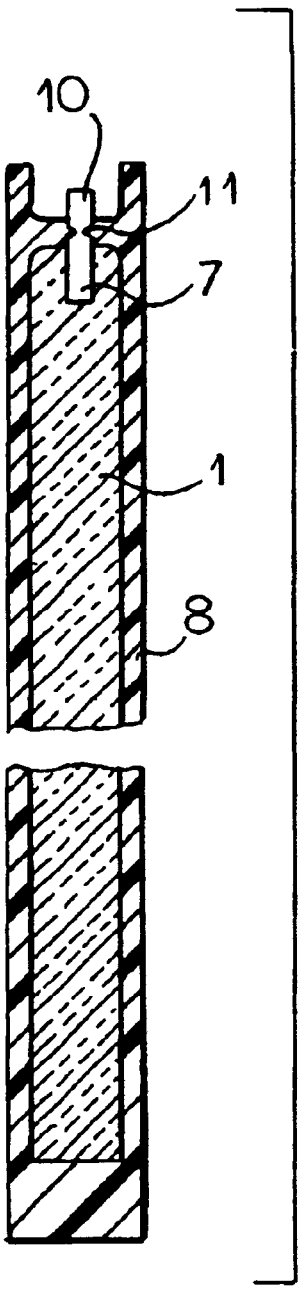
FIG. 3 is a cross sectional view through the wax-covered core of FIG. 1 after the spraying or other application of the wax to the core.

The resulting core is covered with a wax layer 8 of uniform wall thickness by an injection process or by spraying. The core 1 covered by the wax layer 8 has been shown in FIG. 3, the wax layer defining a compartment or space which will later be filled with molten metal which, upon hardening, will form the blade blank. The pins 7 have projecting ends 10 which project beyond the wax layer 8 which otherwise surround the pin and penetrates into circumferential grooves 11 formed in the pins.

Figure 4:
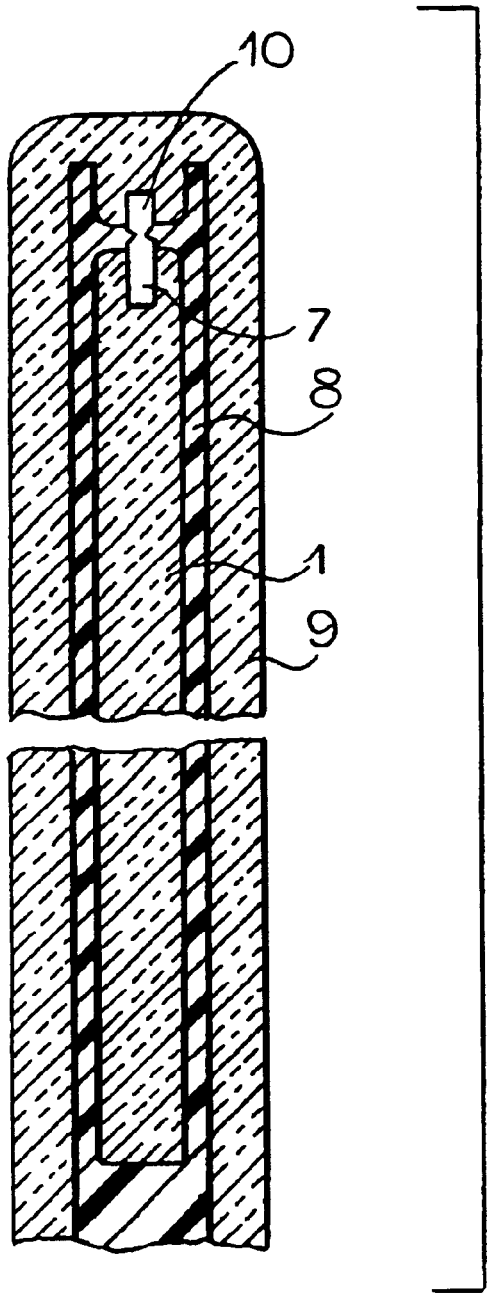
FIG. 4 is a cross sectional view of the wax-covered core after application of the ceramic mold shell to the wax layer.

The mold shell 9 of ceramic is formed by multiple immersions of the wax covered core in a binder and coating with a ceramic material, a process here referred to as sanding. The ceramic sheath which is thus formed has a projecting end 10 of the pins 7 embedded therein. This stage has been illustrated in FIG. 4.

Figure 5:
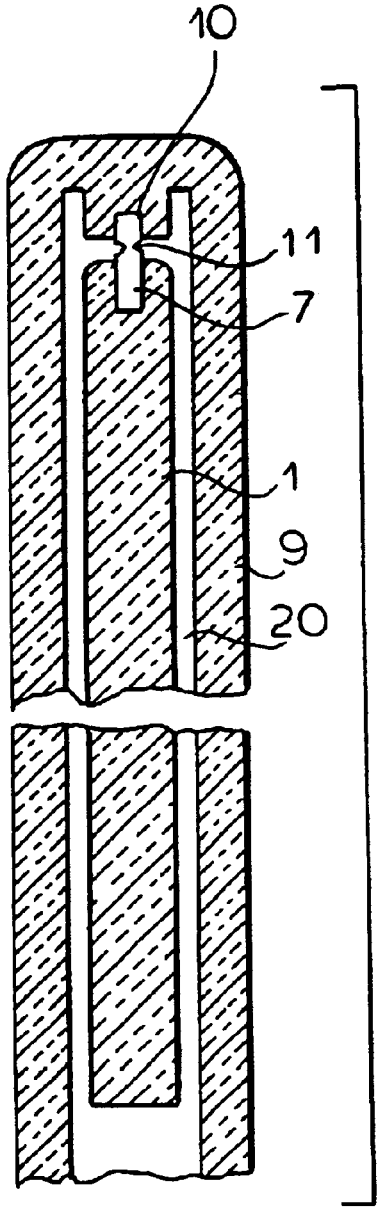
FIG. 5 is a cross sectional view following the removal of the wax and prior to the casting of metal in the resulting space.

After removal of the wax layer 8 (FIG. 5) the mold shell 9 is fired.

Figure 6:
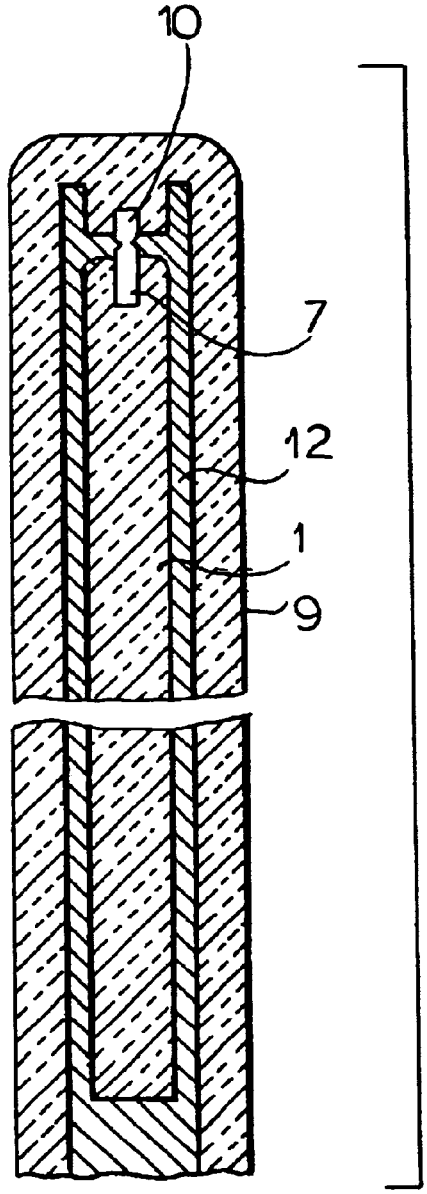
FIG. 6 is a cross sectional view through the assembly after casting of the turbine blade metal therein.

Then the free space 20 left between the core and the shell 9 is filled with molten metal 12 (FIG. 6) which penetrates into the annular groove 11 and provides a form-fit between the molten metal and the pin. This is especially important when the material of the pins tends to oxidize upon firing of the shell 9.

Figure 7:
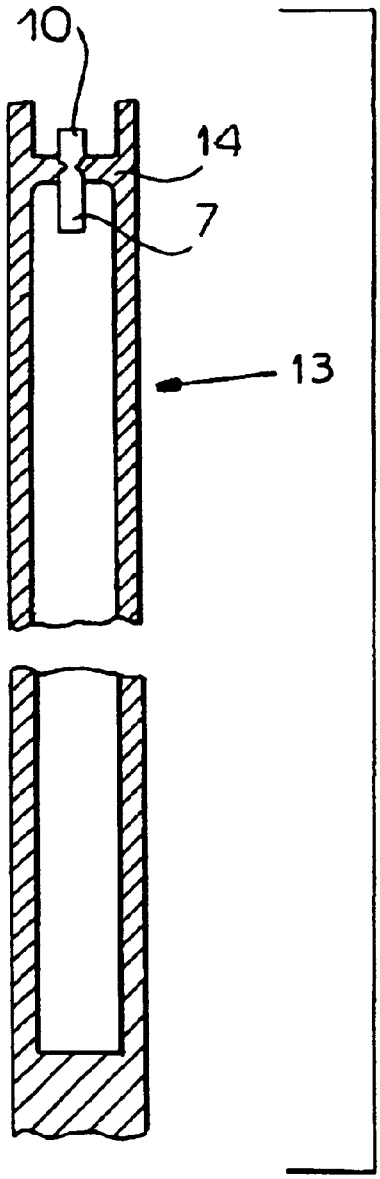
FIG. 7 is a cross sectional view following removal of the core and the mold shell.
Figure 8:
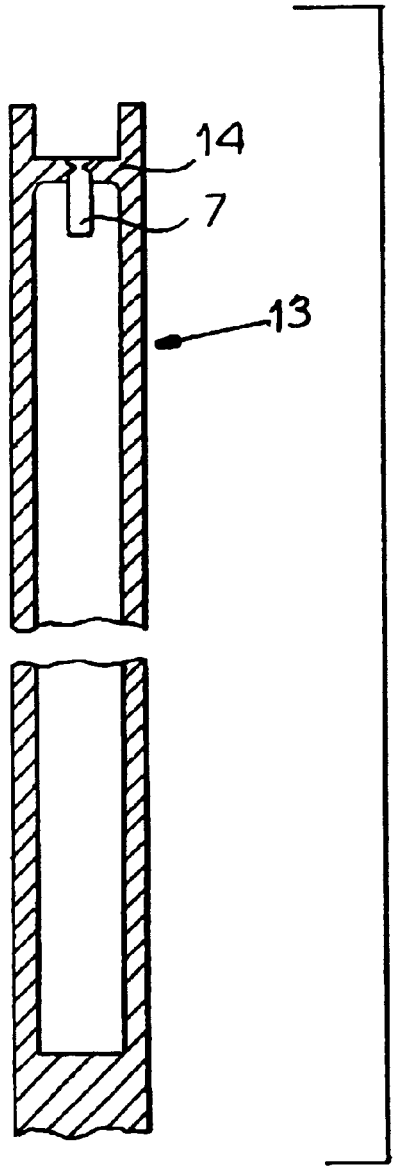
FIG. 8 is a cross sectional view showing the turbine blade after the machining of the outwardly projecting portion of the pin therefrom.

After cooling and solidification of the metal, the core 1 and the mold shell 9 are removed (FIG. 7) and the outer surfaces of the resulting turbine blade blank are machined. The machining process removes as well the outwardly projecting portion 10 of the pin or pins 7 which may extend from the crown bottom 14 of the blade. The pin portion projecting inwardly need not be removed (see FIG. 8 where the completed turbine blade 13 has been shown).

We claim:

1. A method of making a turbine blade having cooling channels therein, said method comprising the steps of:

(a) producing an elongated ceramic core having a base portion at a base of a turbine blade to be made and a free end opposite said base portion, embedding at least one pin at said free end of said core so that said pin projects from said free end, said pin being composed of the nickel-based alloy NiCr82 and being formed with a circumferential groove, said pin being so embedded in the core that the circumferential groove is located in a region of a crown bottom of a turbine blade to be formed;

(b) covering said ceramic core with a wax layer;

(c) forming a ceramic shell on said wax layer by repeated immersion of the ceramic core with the wax layer thereon in a binder and coating with a ceramic material whereby said pin has opposite extremities embedded in said core and in said shell;

(d) removing the wax from between said core and said ceramic shell to leave a space therebetween;

(e) firing said ceramic shell;

(f) casting a molten metal into said space and hardening the metal, thereby forming a turbine blade blank, said pin being incorporated in said turbine blade blank with metal of the blade blank filling said groove to provide a form-fitting engagement of said blade with said pin;

(g) removing the core and the shell from the blade blank whereby said extremities of said pin project therefrom; and (h) machining the blade blank to form the turbine blade, thereby machining away the extremity of said pin which extended into said shell.

* * * * *